US010563925B2

(12) United States Patent
Sakaray et al.

(10) Patent No.: US 10,563,925 B2
(45) Date of Patent: Feb. 18, 2020

(54) COOLING ASSEMBLY FOR SERVICE VEHICLE

(71) Applicant: Caterpillar Inc., Peoria, IL (US)

(72) Inventors: Umakanth Sakaray, Dunlap, IL (US); Dhanasekar Murugan, Peoria, IL (US); Timothy Englert, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 152 days.

(21) Appl. No.: 15/647,363

(22) Filed: Jul. 12, 2017

(65) Prior Publication Data

US 2019/0017747 A1 Jan. 17, 2019

(51) Int. Cl.
*F28D 1/06* (2006.01)

(52) U.S. Cl.
CPC ..... *F28D 1/06* (2013.01)

(58) Field of Classification Search
CPC ..... F28D 1/06; F28D 1/024; F28D 1/05366; F28D 1/0426; F28D 2021/008; F02B 63/04; E21B 36/001; F01P 11/10; F01P 3/18; F01P 2003/185; F28F 9/001; F28F 2009/004; F28F 9/002; F04B 39/06
See application file for complete search history.

(56) References Cited

U.S. PATENT DOCUMENTS 1,227,770 A * 5/1917 Fleischmann ..... F28F 9/001 165/149
3,472,042 A * 10/1969 Shriver ..... F28D 5/02 165/121
3,635,285 A * 1/1972 Davis ..... F01P 5/06 165/51
3,868,992 A * 3/1975 Getz ..... B60K 11/04 165/51
3,921,603 A * 11/1975 Bentz ..... F01P 11/08 123/41.33
3,964,449 A * 6/1976 Thien ..... F01P 3/18 123/41.51
4,034,804 A * 7/1977 Meijer ..... F28D 1/05366 165/148
4,076,072 A * 2/1978 Bentz ..... F01P 3/18 165/41
4,086,976 A * 5/1978 Holm ..... B60K 11/04 123/41.49
4,116,265 A * 9/1978 Staebler ..... B60K 11/04 165/103
4,122,908 A * 10/1978 Miers ..... B60K 11/04 180/68.6

(Continued)

FOREIGN PATENT DOCUMENTS

CN 203785486 8/2014
DE 102007042745 3/2009

(Continued)

*Primary Examiner* — Ljiljana V. Ciric

(57) ABSTRACT

A cooling assembly, for a service vehicle, includes a frame arranged to define an internal cavity, with the frame having six faces: a bottom face, a top face, and four side faces. The first face is configured to be mounted on the service vehicle. Three of the four side faces are each configured to have at least one cooler mounted thereon. A remaining one of the four side faces is positioned facing an engine of the service vehicle and has a barrier element to restrict drawing air through the remaining one of the four faces.

20 Claims, 4 Drawing Sheets

(56) References Cited

U.S. PATENT DOCUMENTS 4,202,296 A * 5/1980 Nonnenmann ..... F01P 11/10 123/41.48
4,287,961 A * 9/1981 Steiger ..... B60K 11/04 123/41.43
4,339,014 A * 7/1982 Berth ..... B60K 11/08 180/68.1
4,454,926 A * 6/1984 Akins ..... B60K 11/08 123/41.7
4,589,379 A * 5/1986 Fujikawa ..... F01P 5/06 123/41.49
4,657,070 A * 4/1987 Kluppel ..... F28B 1/06 165/110
4,696,361 A * 9/1987 Clark ..... F01P 3/18 123/41.43
4,736,727 A * 4/1988 Williams ..... B60K 11/04 123/41.31
4,862,981 A * 9/1989 Fujikawa ..... B60K 5/10 180/68.4
5,046,550 A * 9/1991 Boll ..... B60H 1/3227 123/41.31
5,180,003 A * 1/1993 Kouzel ..... F01P 5/02 123/41.49
5,234,051 A * 8/1993 Weizenburger ..... B60K 11/04 123/41.31
5,492,167 A * 2/1996 Glesmann ..... B60P 3/32 123/563
5,649,587 A * 7/1997 Plant ..... F01P 5/06 123/41.49
6,129,056 A * 10/2000 Skeel ..... F01P 3/18 123/41.49
6,401,801 B1 * 6/2002 Dicke ..... B60K 11/04 123/41.33
6,427,766 B2 * 8/2002 Zobel ..... F01P 11/029 123/41.49
6,435,264 B1 * 8/2002 Konno ..... B60K 11/04 123/41.49
6,474,290 B1 * 11/2002 Coffey ..... B01D 46/0023 123/198 C
6,564,857 B1 * 5/2003 Zobel ..... F28D 1/0426 123/41.49
6,585,035 B2 * 7/2003 Zobel ..... F01P 5/04 123/41.49
6,655,486 B2 * 12/2003 Oshikawa ..... B60K 11/08 180/68.1
6,659,685 B1 * 12/2003 Persson ..... E01C 19/38 404/133.05
6,675,879 B2 * 1/2004 Voss ..... F28D 1/0426 123/41.49
6,695,047 B2 * 2/2004 Brocksopp ..... F01P 3/18 123/41.04
6,779,591 B2 * 8/2004 Ehlers ..... F01P 3/18 123/41.49
6,782,849 B2 * 8/2004 Roithinger ..... F01P 3/18 123/41.56
6,793,028 B2 * 9/2004 Pack ..... B60K 11/04 180/68.1
6,832,643 B1 * 12/2004 Zobel ..... F28F 9/02 123/41.49
7,040,260 B2 * 5/2006 Yoshimatsu ..... F01P 5/06 123/41.49
7,051,786 B2 * 5/2006 Vuk ..... B60K 11/04 165/41
7,143,852 B2 * 12/2006 Yatsuda ..... B62D 25/10 180/69.2
7,204,329 B2 * 4/2007 Pfohl ..... B60K 11/04 180/68.1
7,299,861 B2 * 11/2007 Lo ..... F28D 1/0471 165/125
7,320,299 B2 * 1/2008 Eavenson, Sr. ..... F01N 13/082 123/41.49
7,753,152 B2 * 7/2010 Nakae ..... B60K 11/04 165/122
7,814,963 B2 * 10/2010 Adamson ..... B60K 11/04 123/41.31
7,992,665 B2 * 8/2011 Giovannini ..... B62D 25/10 180/69.2
8,453,777 B2 * 6/2013 Farlow ..... F04D 17/16 180/68.1
8,490,730 B2 * 7/2013 Ringer ..... F16J 12/00 180/68.1
8,770,329 B2 * 7/2014 Spitler ..... B60K 11/04 180/68.1
8,875,823 B2 * 11/2014 Lauper, Jr. ..... F01P 5/06 180/68.1
8,936,122 B2 * 1/2015 MacGregor ..... B60K 11/04 180/68.1
8,967,239 B2 * 3/2015 Schertz ..... F28F 27/00 165/202
9,074,780 B2 * 7/2015 Lee ..... F24F 1/0059
9,581,071 B2 * 2/2017 Kim ..... F01P 1/06
10,281,169 B2 * 5/2019 Hjorth ..... F24H 3/06
10,344,661 B2 * 7/2019 Ikeda ..... F02N 11/0862
2002/0053480 A1 * 5/2002 Pack ..... B60K 11/04 180/374
2003/0057005 A1 3/2003 Nagai et al.
2004/0129407 A1 * 7/2004 Stone ..... B60K 11/04 165/41
2004/0173395 A1 * 9/2004 Arai ..... B60K 11/04 180/68.1
2004/0226683 A1 * 11/2004 Esposito ..... B60K 11/04 165/41
2006/0131885 A1 * 6/2006 Wurtele ..... B60H 1/00378 290/1 A
2008/0223319 A1 * 9/2008 Nakashima ..... E02F 9/0866 123/41.66
2009/0199792 A1 * 8/2009 Kondou ..... B60K 11/02 123/41.49
2011/0057454 A1 * 3/2011 Kawakita ..... F02B 63/04 290/1 A
2014/0138066 A1 * 5/2014 Bibb, III ..... F28F 9/002 165/121
2014/0262147 A1 * 9/2014 Pawlick ..... F28F 9/001 165/67
2016/0031311 A1 * 2/2016 Inaoka ..... B60K 11/04 180/68.4
2017/0292736 A1 * 10/2017 Hjorth ..... F24H 3/06

FOREIGN PATENT DOCUMENTS

DE 102010014506 10/2011
JP 2003097286 4/2003
JP 2005016083 1/2005
JP 2009292255 12/2009

* cited by examiner

COOLING ASSEMBLY FOR SERVICE VEHICLE

TECHNICAL FIELD

The present disclosure relates to a cooling assembly, and more particularly to the cooling assembly for a service vehicle.

BACKGROUND

Service vehicles, for example gas or oil fracturing vehicles, have many components such as an engine, a transmission system, a hydraulic system, a fracturing pump, among others, that are present on the service vehicle, and that may heat up during operation. These components require cooling by means of heat exchange with suitable radiators or other coolers based on the type of the components.

A box type cooling package having multiple coolers present on each of the four side faces of the cooling package may be utilized to cool the heated components. A fan is mounted on a top face of the cooling package for cooling fluids running through the coolers by drawing cool ambient air from around the cooling package. Based on the design, these cooling packages may draw air from all four side faces of the cooling package.

However, some components of the service vehicle that are positioned proximate to the cooling package, for example an engine of the service vehicle that may be hot can cause the air surrounding that engine to heat up. Thus, hot air may be drawn into the cooling package from the side face proximate to the engine. This may affect an overall cooling performance of the system. Further, the placement of the coolers on each of the four side faces of the cooling package may lead to a bulky design requiring considerable space. Some service vehicles may have limited space for the installation of the cooling package, making it challenging to accommodate the cooling package.

United States Published Application Number 2003/057005 describes an engine enclosure for use on a vehicle having a cooling system for a vertical shaft type engine with a cooling air intake fan disposed above the engine. The engine enclosure comprises an upper hood for covering the engine from above, the upper hood having an upper surface and right and left side surfaces extending downward from the upper surface, a lower hood for covering lateral areas of the engine, and a cooling air intake opening formed in a position above a lower end of at least one of the right and left side surfaces of the upper hood for taking in ambient air. A partition wall member is disposed between the cooling air intake opening and the cooling air intake fan for restricting mixing of ambient air drawn by the fan and heat generating from the engine.

SUMMARY OF THE DISCLOSURE

In one aspect of the present disclosure, a cooling assembly for a service vehicle is provided. The cooling assembly includes a frame having a bottom face, a top face, and four side faces, all arranged to define an internal cavity. The bottom face is configured to be mounted on the service vehicle. The top face is opposite the bottom face and is configured to be fitted with a fan. Three of the four side faces are each configured to be fitted with at least one cooler. A remaining one of the four side faces is adjacent to and facing an engine of the service vehicle. The remaining face has a barrier element provided thereon. The barrier element is configured to restrict air from being drawn therethrough.

In another aspect of the present disclosure, a service vehicle is provided. The service vehicle includes a mainframe, an engine supported on the mainframe, and a cooling assembly. The cooling assembly includes a frame having a bottom face, a top face, and four side faces, all arranged to define an internal cavity. The bottom face is configured to be mounted on the service vehicle. The top face is opposite the bottom face and is configured to be fitted with a fan. Three of the four side faces are each configured to be fitted with at least one cooler. A remaining one of the four side faces is adjacent to and facing an engine of the service vehicle. The remaining face has a barrier element provided thereon. The barrier element is configured to restrict air from being drawn therethrough.

In yet another aspect of the present disclosure, a method for cooling of components of a service vehicle is provided. The method includes aligning a frame having four side faces, a bottom face, and a top face on a mainframe of the service vehicle. The method includes attaching the bottom face of the frame to the mainframe. The method includes fitting a fan on the top face of the frame. The method includes fitting at least one cooler on three of the four side faces of the frame. The method includes providing a barrier element on a remaining one of the four side faces of the frame proximate to and facing an engine of the service vehicle to restrict drawing air therethrough. The method includes operating the fan for drawing an airflow from each of the three of the four side faces of the frame for cooling the at least one cooler.

Other features and aspects of this disclosure will be apparent from the following description and the accompanying drawings.

DETAILED DESCRIPTION

Wherever possible, the same reference numbers will be used throughout the drawings to refer to the same or the like parts. Also, corresponding or similar reference numbers will be used throughout the drawings to refer to the same or corresponding parts.

Figure 1:
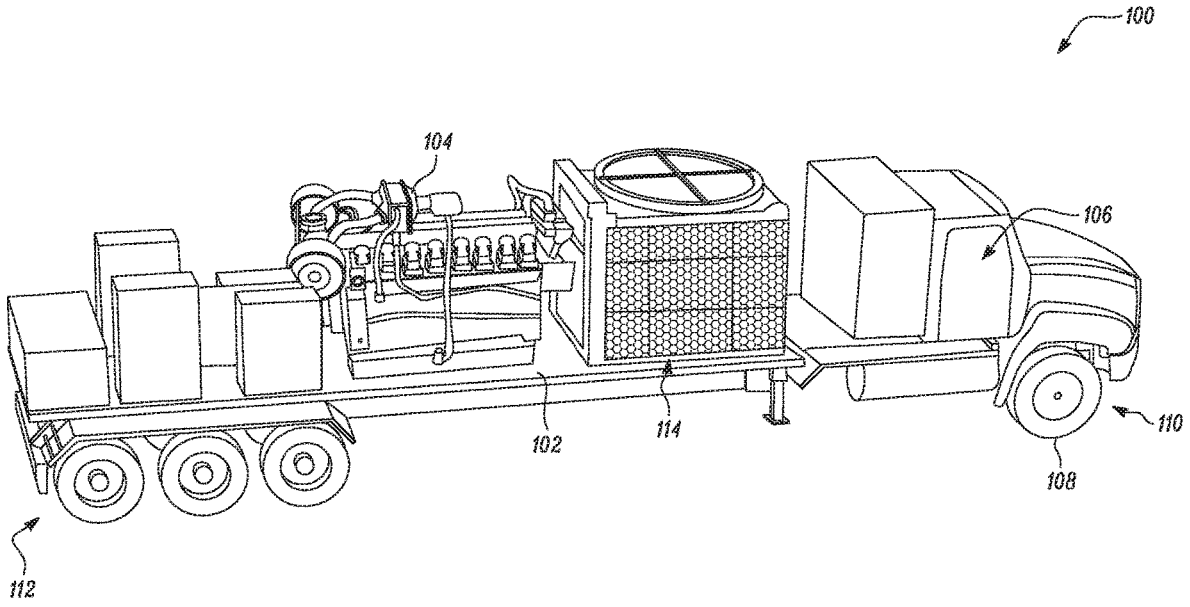
FIG. 1 is a perspective side view of an exemplary service vehicle, according to various concepts of the present disclosure.

Referring to FIG. 1, an exemplary service vehicle 100 is illustrated. The machine is embodied as the service vehicle 100 is embodied as a trailer to serve at a gas or oil fracturing site. The service vehicle 100 includes a mainframe 102 having a number of components mounted thereon. An engine 104 is attached to the mainframe 102 of the service vehicle 100. An operator cabin 106 is provided on the service vehicle 100. A number of wheels 108 are positioned at a front end 110 and a rear end 112 of the service vehicle 100 for mobility. The service vehicle 100 additionally includes other components for example, a transmission system (not shown), a hydraulic system (not shown), a fracturing pump (not shown), and so on for performing fracturing operations.

To perform the fracturing operation, fracturing fluid may be pumped into a wellbore at high pressure. Inside the wellbore, the fracturing fluid is forced into a formation being produced. When the fracturing fluid enters the formation, the fracturing fluid fractures, or creates fissures, in the formation. Water, as well as other fluids, and some solid proppants, may then be pumped into the fissures to stimulate the release of oil and gas from the formation. In some cases, fracturing rock in the formation may require that the fracturing fluid be pumped into the wellbore at very high pressure. This pumping is typically performed by the relatively large diesel-powered fracturing pumps.

During operation, some of the components of the service vehicle 100 may get heated up, requiring the components to be cooled. For example, the engine 104, the transmission system, the hydraulic system, the fracturing pump, and so on may need to be cooled. The present disclosure relates to a cooling assembly 114 associated with the service vehicle 100. The cooling assembly 114 is a box type cooling system and will be explained in detail relating to FIGS. 2 and 3.

Figure 2:
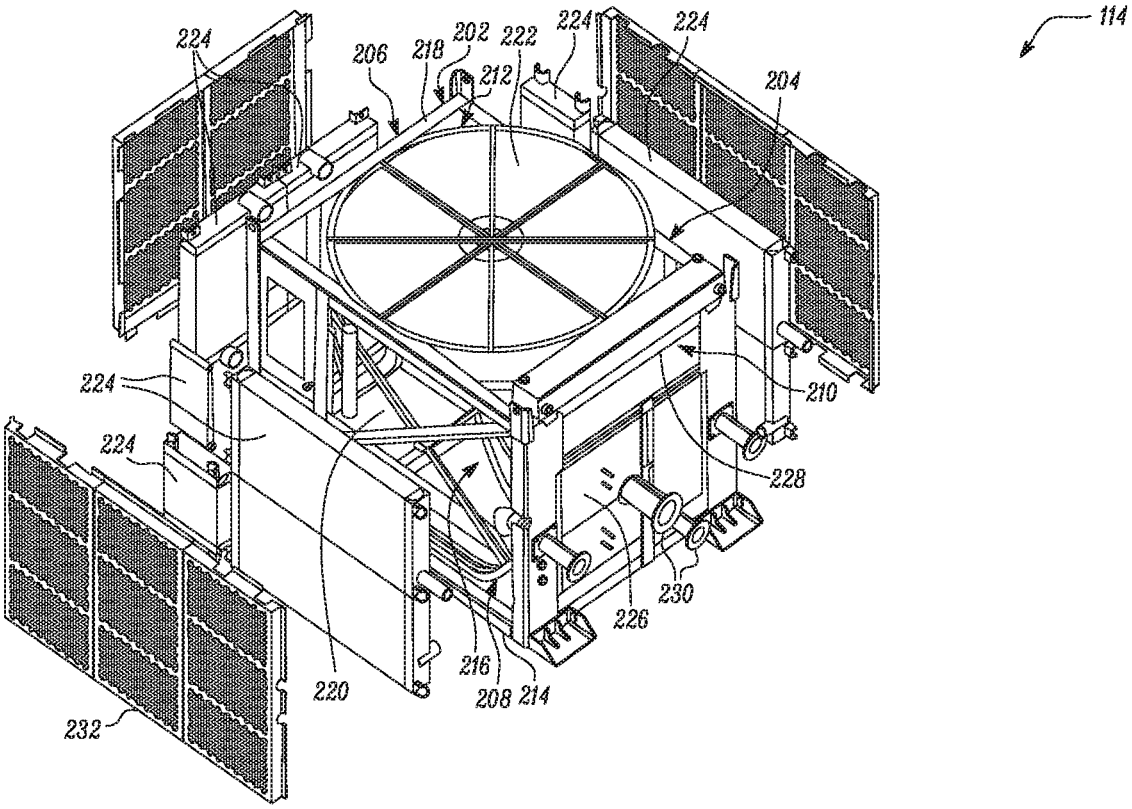
FIG. 2 is a perspective exploded view of a cooling assembly associated with the service vehicle of FIG. 1, according to various concepts of the present disclosure.
Figure 3:
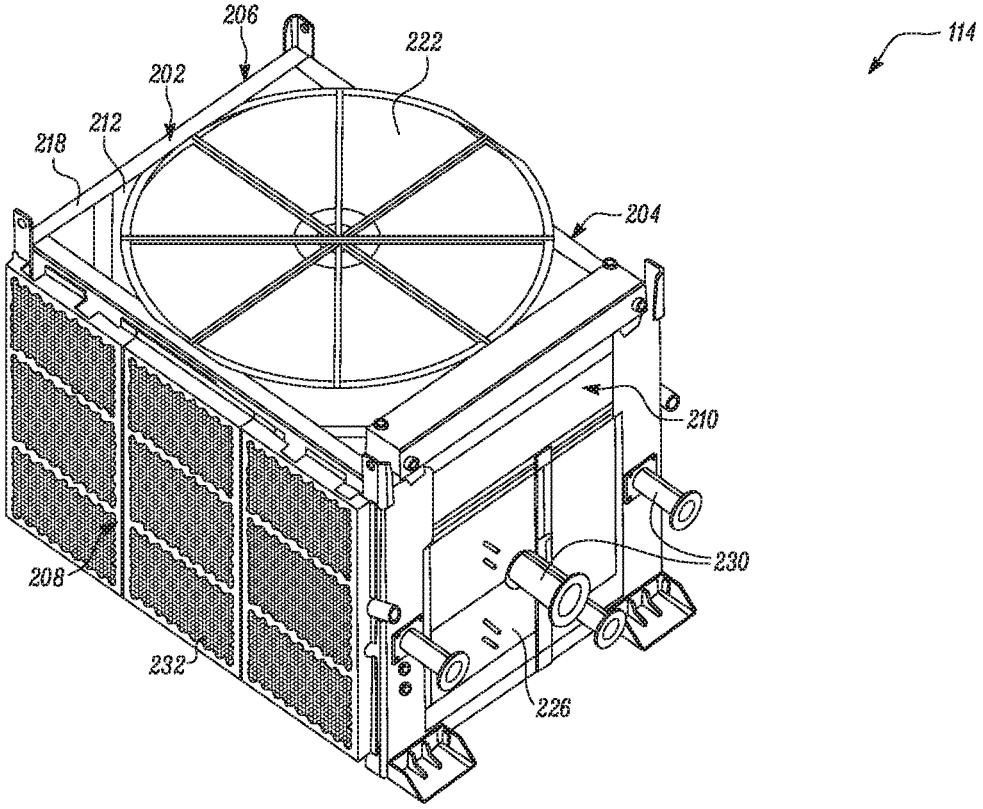
FIG. 3 is a perspective assembled view of the cooling assembly of FIG. 2, according to various concepts of the present disclosure.

Referring to FIGS. 2 and 3, the cooling assembly 114 has a frame 202. The frame 202 has a hollow box type shape. The frame 202 includes four side faces, that is 204, 206, 208, 210, a top face 212, and a bottom face 214 that define an internal cavity 216 of the frame 202. The top face 212 is opposite to the bottom face 214. The four side faces 204, 206, 208, 210 are positioned adjacent to one another. The frame 202 is formed by a number of support members 218 that are arranged to define the box shape of the frame 202.

The bottom face 214 of the frame 202 is mounted on the service vehicle 100. In some embodiments, one more support panels 220 may be provided on the bottom face 214 of the cooling assembly 114 for firmly connecting the cooling assembly 114 to the service vehicle 100. In one example, the cooling assembly 114 is mounted on the mainframe 202 of the service vehicle 100, proximate to the engine 104. A fan 222 is mounted on the top face 212. In some embodiments, the fan 222 is made of plastic, to reduce the weight of the fan 222. The fan 222 may also be connected to a motor, a fan shroud, and other components associated therewith.

Three of the four side faces, that is 204, 206, 208, hereinafter referred to as three side faces 204, 206, 208, may have multiple coolers 224 installed thereon. More particularly, each of the three side faces 204, 206, 208 may include one or more coolers 224. Further, the coolers 224 on each of the three side faces 204, 206, 208 may be of different types. For example, the coolers 224 may include any of a radiator, a fuel cooler, a hydraulic oil cooler, a power end lubrication cooler, and/or a charge air cooler. Additionally, or optionally, other coolers 224 for cooling of other components on the service vehicle 100 may also be accommodated on the frame 202. Lines, pipes, and other connections, for example charge air lines, coolant and/or oil lines, associated with the coolers 224 may be housed within the internal cavity 216 of the frame 202.

An exemplary arrangement includes providing radiators and a power end lubrication coolers on one of the three side faces 204; charge air coolers 224 on another of the three side faces 206; radiators, a fuel cooler, and a hydraulic oil cooler on yet another of the three side faces 208. It must be noted that the arrangement of the coolers 224 on the three side faces 204, 206, 208 of the frame 202 may vary based on a length, a breadth, and/or a height of the frame 202. The arrangement shown in the accompanying figures is exemplary and does not limit the scope of the present disclosure.

A barrier element 226 is provided on a remaining one of the four side faces, hereinafter referred to as the one side face 210, of the cooling assembly 114. The barrier element 226 is provided proximate to and facing the engine 104 of the service vehicle 100. The barrier element 226 may be made of sheet metal. In one example, the one side face 210 may include channels (not shown) provided on an inner perimeter 228 thereof for receiving the barrier element 226, such that the barrier element 226 is affixed in position using mechanical fasteners. The barrier element 226 is configured to restrict and block the drawing of air from areas proximate to the engine 104. The barrier element 226 also causes sealing of the one side face 210 from ambient air, preventing air from entering the internal cavity 216 of the frame 202 when the fan 222 is switched on. The barrier element 226 includes a number of ports 230 provided thereon for fluidic connection between the coolers 224 and the other components of the service vehicle 100, for example, the engine 104 and a hydraulic pump (not shown).

Additionally, the frame 202 may include other support structures, such as support arms, frames, panels, brackets and so on for firmly holding the components in place on the frame 202. A core guard 232 is connected to the three side faces 204, 206, 208 via mechanical fasteners, such as bolts.

During operation, the fan 222 is switched on in suction mode, causing an airflow to be drawn from each of the three side faces 204, 206, 208 of the frame 202, except for the one side face 210 which is located near the engine 104. The barrier element 226 on the one side face 210 prevents, restricts, and blocks the air from being drawn through the one side face 210 and the areas proximate to the engine 104. The operation of the fan 222 causes cooling of the coolers 224 by heat exchange therewith.

The frame 202 may be made of any suitable material, for example, metal. The design, construction, shape, and/or dimensions of the frame 202 may vary based on the requirements of the system. The arrangement of the coolers 224 on the three side faces 204, 206, 208 of the frame 202 may also vary based on the requirements of the system.

INDUSTRIAL APPLICABILITY

Figure 4:
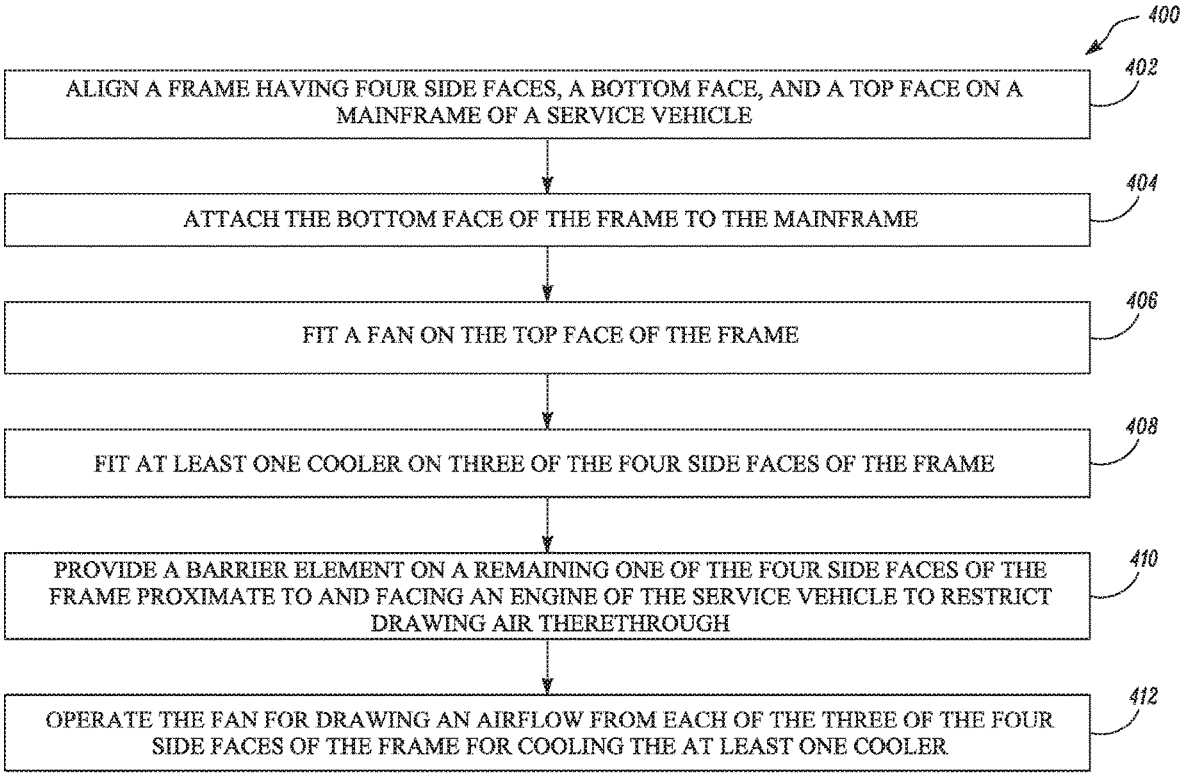
FIG. 4 is a flowchart of a method for cooling components of the service vehicle, according to various concepts of the present disclosure.

The present disclosure provides the cooling assembly 114 for cooling of the components of the service vehicle 100. FIG. 4 illustrates a flowchart of a method for cooling of the components of the service vehicle 100. At step 402, the frame 202 having the four side faces 204, 206, 208, 210, the top face 212, and the bottom face 214 is aligned on the mainframe 202 of the service vehicle 100. At step 404, the bottom face 214 is attached to the mainframe 202. At step 406, the fan 222 is mounted on the top face 212 of the frame 202. At step 408, one or more coolers 224 are fitted on the three side faces 204, 206, 208 of the frame 202. At step 410, the barrier element 226 is provided on the one side face 210 of the frame 202 proximate to and facing the engine 104 of the service vehicle 100. The barrier element 226 restricts drawing air through the one side face 210. At step 412, the fan 222 is operated to draw the airflow from each of the three side faces 204, 206, 208 of the frame 202 for cooling the coolers 224.

The present cooling assembly 114 provides an effective solution for cooling the coolers 224 associated with the components of the service vehicle 100. The cooling assembly 114 has a box type cooling package design. When the fan 222 is operated in suction mode, the airflow is drawn from each of the three side faces 204, 206, 208 of the cooling assembly 114 having the coolers 224 installed thereon. The barrier element 226 mounted on the one side face 210 proximate to the engine 104 prevents the air from being drawn through the said side 210.

By preventing drawing of the air from the one side face 210 that faces the engine 104, an overall cooling performance of the system may be improved since the barrier element 226 blocks the heated air surrounding the engine 104 from entering the internal cavity 216 of the frame 202 when the fan 222 is operated in suction mode. Further, closing or blocking the one side face 210 by the barrier element 226 may assist in redistributing package restriction in such a way that the airflows with relatively higher velocity may be drawn through each of the three side faces 204, 206, 208 having the coolers 224 mounted thereon, further enhancing the cooling performance of the system.

The cooling assembly 114 offers a robust and compact solution having the coolers 224 mounted on each of the three side faces 204, 206, 208 of the cooling assembly 114, allowing the cooling assembly 114 to be installed in environments having space constraints. Further, the cooling assembly 114 may be relatively light weight and may be easily retrofitted onto existing machines. In some situations, for example in case of inspection or servicing, the barrier element 226 may be removed to access the internal cavity 216 of the frame 202, without having to go underneath the service vehicle 100.

Although the cooling assembly 114 has been described in connection with the service vehicle 100, the cooling assembly 114 may also be used in generator sets and other electric power applications.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A cooling assembly for a service vehicle, the cooling assembly comprising:
- a frame having a plurality of faces that define an internal cavity,
  - wherein the plurality of faces include:
    - a first face that is configured to be mounted on the service vehicle,
    - a second face that is opposite the first face and is configured to be fitted with a fan,
    - a third face this is configured to be fitted with at least one cooler, and
    - a fourth face that is adjacent to the third face and configured to face an engine of the service vehicle,
      - the fourth face having a barrier element,
      - the barrier element being configured to restrict air from being drawn through the fourth face,
      - the fourth face including at least one channel adapted to receive the barrier element, and
      - the barrier element being held in position using mechanical fasteners.

2. The cooling assembly of claim 1, wherein the at least one cooler includes one or more of a radiator, a fuel cooler, a hydraulic oil cooler, a power end lubrication cooler, or a charge air cooler.

3. The cooling assembly of claim 1, wherein the third face is fitted with a plurality of coolers that include the at least one cooler.

4. The cooling assembly of claim 1, further comprising:
- a core guard provided on the fourth face.

5. The cooling assembly of claim 1, wherein the barrier element is made of sheet metal.

6. The cooling assembly of claim 1, further including:
- at least one support panel attached to the first face.

7. The cooling assembly of claim 1,
- wherein the at least one cooler includes a plurality of coolers, and
- wherein an arrangement of the plurality of coolers is based on at least one of a length, a breadth, or a height of the frame.

8. The cooling assembly of claim 1, wherein the frame includes a plurality of support arms.

9. A service vehicle comprising:
- a mainframe;
- an engine supported on the mainframe; and
- a cooling assembly comprising:
  - a frame having a plurality of faces that define an internal cavity,
    - wherein the plurality of faces include:
      - a first face that is configured to be mounted on the service vehicle,
      - a second face that is opposite the first face and is configured to be fitted with a fan,
      - a third face this is configured to be fitted with at least one cooler, and
      - a fourth face that is adjacent to the third face and configured to face an engine of the service vehicle,
        - the fourth face having a barrier element,
        - the barrier element being configured to restrict air from being drawn through the fourth face,
        - the fourth face including at least one channel adapted to receive the barrier element, and
        - the barrier element being held in position using mechanical fasteners.

10. The service vehicle of claim 9, wherein the at least one cooler includes one or more of a radiator, a fuel cooler, a hydraulic oil cooler, a power end lubrication cooler, or a charge air cooler.

11. The service vehicle of claim 1, wherein the third face is fitted with a plurality of coolers that include the at least one cooler.

12. The service vehicle of claim 9, further comprising:
- a core guard provided on the fourth face.

13. The service vehicle of claim 9, wherein the barrier element is made of sheet metal.

14. The service vehicle of claim 9, further including:
- at least one support panel attached to the first face.

15. The service vehicle of claim 9,
- wherein the at least one cooler includes a plurality of coolers, and
- wherein an arrangement of the plurality of coolers is based on at least one of a length, a breadth, or a height of the frame.

16. The service vehicle of claim 9, wherein the frame includes a plurality of support arms.

17. A system comprising:
- a frame comprising a plurality of faces that define an internal cavity,
  - wherein the plurality of faces include:
    - a first face that is configured to be mounted on a service vehicle, a second face that is opposite the first face,
a third face this is fitted with a first cooler,
a fourth face that is fitted with a second cooler,
a fifth face that is fitted with a third cooler, and
a sixth face,
wherein the sixth face is adjacent to the third face and the fourth face, and
wherein the sixth face is configured to face an engine of the service vehicle,
wherein the sixth face has a barrier element, and
wherein the barrier element is configured to restrict air from being drawn through the sixth face.

18. The system of claim 17, wherein each one of the third face, the fourth face, and the fifth face has a plurality of coolers.

19. The system of claim 17, wherein the sixth face includes at least one channel adapted to receive the barrier element.

20. The system of claim 17, wherein the barrier element is held in position using mechanical fasteners.

* * * * *